US005322230A

United States Patent [19]

Dylla et al.

[11] Patent Number: 5,322,230

[45] Date of Patent: Jun. 21, 1994

[54] METHOD AND APPARATUS FOR PREPARING A REPLACEMENT PAPER ROLL FOR FLYING ROLL CHANGE, PARTICULARLY TO SUPPLY PAPER TO A ROTARY PRINTING PRESS

[75] Inventors: Norbert Dylla, Stadtbergen; Anton Hamm; Michael Wörner, both of Neusäss, all of Fed. Rep. of Germany

[73] Assignee: MAN Roland Druckmaschinen AG, Offenbach am Main, Fed. Rep. of Germany

[21] Appl. No.: 970,917

[22] Filed: Nov. 3, 1992

[30] Foreign Application Priority Data

Dec. 14, 1991 [DE] Fed. Rep. of Germany ..... 4141242

[51] Int. Cl.[5] ..... B65H 19/18

[52] U.S. Cl. ..... 242/58.5; 156/504; 242/56.8

[58] Field of Search ..... 242/58.5, 58.1, 58.2, 242/58.3, 58.4, 56.8; 156/504, 502

[56] References Cited

U.S. PATENT DOCUMENTS

| | | | |
|---|---|---|---|
| 2,104,774 | 1/1938 | Scott | 242/58.5 |
| 2,553,928 | 5/1951 | McMullen | 242/58.5 |
| 3,547,739 | 12/1970 | Beute | 156/504 |
| 4,284,463 | 8/1981 | Wright | 156/502 |
| 4,575,017 | 3/1986 | Pali | 242/58.5 X |
| 4,802,632 | 2/1989 | Fukuda et al. | 242/58.5 |
| 5,212,002 | 5/1993 | Madrzak et al. | 242/58.5 X |

FOREIGN PATENT DOCUMENTS

| | | |
|---|---|---|
| 0418527 | 3/1991 | European Pat. Off. . |
| 3811138 | 6/1989 | Fed. Rep. of Germany . |
| 452328 | 8/1936 | United Kingdom . |

*Primary Examiner*—John M. Jillions

*Attorney, Agent, or Firm*—Frishauf, Holtz, Goodman & Woodward

[57] ABSTRACT

To automate the preparation of a replacement paper roll for flying roll changing, initial layer portions of web material from the replacement paper roll and which, typically, are damaged, are rolled on a scrap roll (2) to form scrap material windings thereon. In a first moving step, the scrap roll (2) is placed in engagement with the replacement paper roll to wind scrap material thereon. When a sensing element (22) senses that the paper is suitable for printing, the scrap roll is moved away from the replacement roll (1) and into a preparation or processing position (FIG. 11). At that processing position, two spaced axially extending perforation or tear lines (4, 5) are formed in the beginning portion. In a third moving step, the beginning portion is placed in engagement with the paper roll by moving the scrap roll back towards the replacement roll and, preferably, adhered thereto temporarily by a holding adhesive. In a fourth moving step, the paper on the scrap roll and on the replacement is severed along one (5) of the perforating lines, and the scrap roll is then moved away from the replacement roll for removal of scrap material thereon. Preferably, all elements other than the replacement paper roll are retained in a frame which can be moved towards and away from the replacement roll, and includes the elements, as well as drive and guide devices therefor.

20 Claims, 8 Drawing Sheets

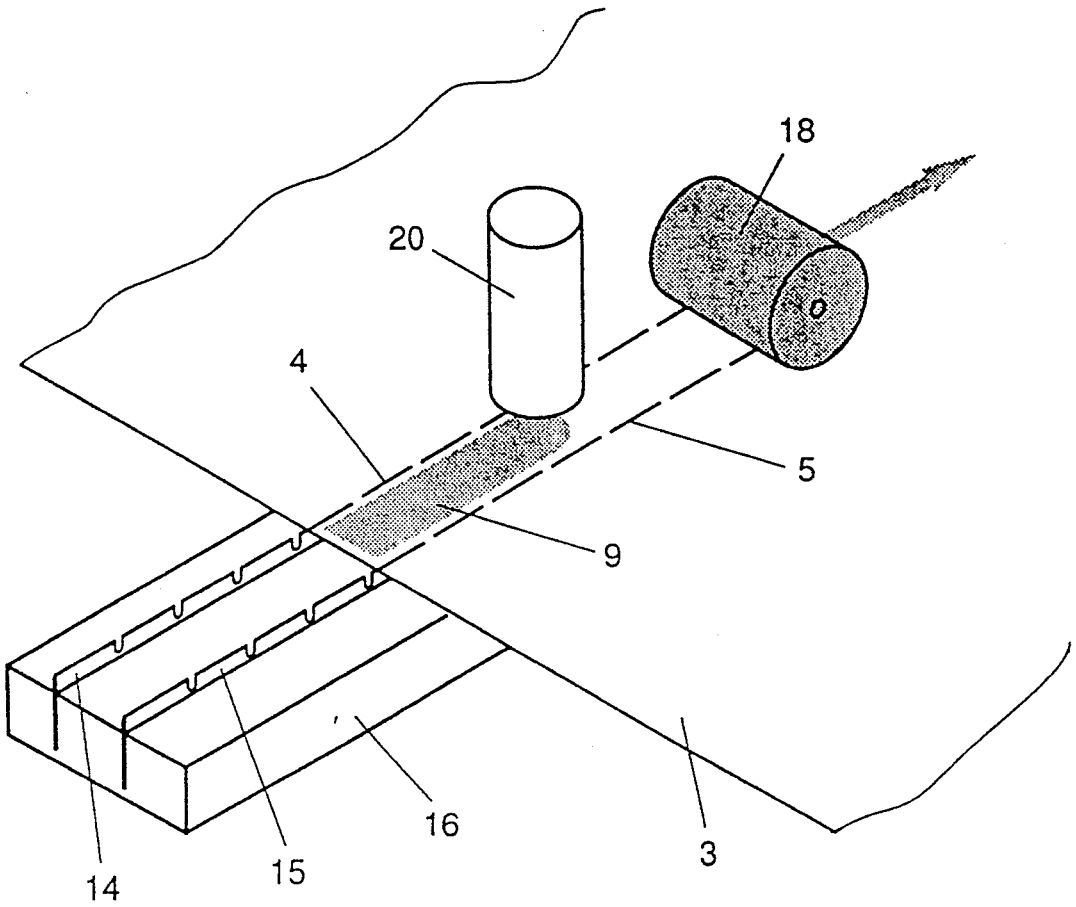
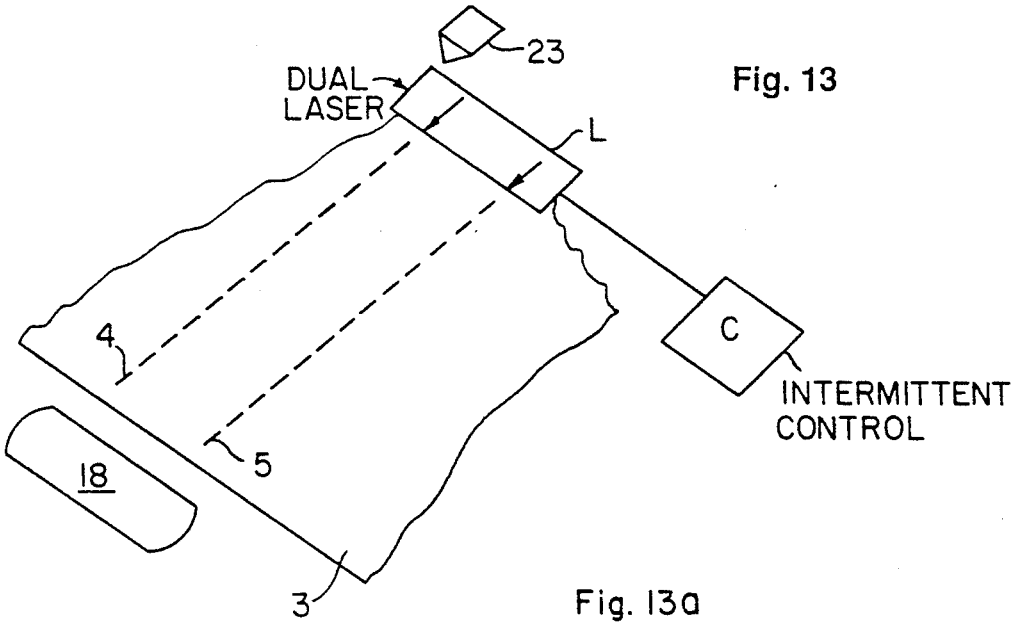
Fig. 13
Fig. 13a

METHOD AND APPARATUS FOR PREPARING A REPLACEMENT PAPER ROLL FOR FLYING ROLL CHANGE, PARTICULARLY TO SUPPLY PAPER TO A ROTARY PRINTING PRESS

Reference to related patent, the disclosure of which is hereby incorporated by reference:

U.S. Pat. No. 4,802,632, Fukuda et al.

Reference to related applications, the disclosure of which are hereby incorporated by reference, and assigned to the assignee of the present application:

U.S. Ser. No. 07/882,599, filed May 13, 1992, Dylla et al;

U.S. Ser. No. 07/971,042, filed Nov. 3, 1992, Dylla.

FIELD OF THE INVENTION

The present invention relates to a method and an apparatus to prepare the beginning portion of a replacement paper web roll for flying roll changing, so that the beginning portion of the paper web roll can be adhered to a trailing end of an expiring roll.

BACKGROUND

Various systems have been provided to adhere the beginning portion of a new paper web roll to the trailing or end portion of an expiring paper web roll, so that the paper web from the new roll will be pulled through the printing machine by the expiring web. An adhesive is applied to the new or the expiring paper, respectively, to provide for such adhesion. Scrap paper layers, which are unavoidable on rolls of substrate web used in printing machines, are severed from the undamaged paper web on which printing is to be effected.

The referenced application Ser. No. 07/882,599, filed May 13, 1992, by the inventor hereof, describes an apparatus which permits such adhesion to form an effectively continuous web. The initial or beginning portion of the replacement web is manually guided to a processing station, where the beginning portion is perforated and the connecting adhesive is applied. The scrap is cut off and the now prepared beginning portion of the web is engaged against the replacement roll, and temporarily adhered by a holding adhesive. The system is highly effective; if a large number of replacement rolls, however, have to be prepared, the effort by the operators and the working time is high.

The referenced U.S. Pat. No. 4,802,632, Fukuda et al, describes a method and a process to form an adhesion tip on a replacement roll. The replacement roll is placed in a spool-off apparatus of a machine which handles the web, and is there specifically located in a splicing position. After the initial layers of scrap have been removed, the initial portion of the web is spooled or wound backward and two knives move from the edges of the roll towards the center of the web to generate a V-shaped cut. Adhesive is applied along the edge of the V cut, and this adhesion tip, as the web continues to be spooled back, is wound back on the replacement roll. The roll is closed, that is, the adhesion flap or tip is adhered to the underlying layer of the roll by a previously applied strip.

Due to the complex geometry of the adhesion tip, the apparatus is complex and expensive. Preparation of the roll to apply the adhesion strip alone is complex.

THE INVENTION

It is an object to provide a method and a system to prepare the beginning portion of a replacement roll for flying roll changes, in which the method can be readily carried out by machinery, not requiring sequential operator steps. The machinery or apparatus to carry out the method should be simple and readily constructed from available machine elements.

Briefly, a roll is provided on which scrap material from the replacement roll can be wound and, in a first moving step, the scrap roll and the replacement roll are moved towards each other, for example by moving the scrap roll in a movable frame towards the replacement roll, which can be held in a roll changer or otherwise in a fixed support. The initial portion of scrap material is wound from the replacement roll on the scrap roll to form a scrap winding on the scrap roll. In a second moving step, the replacement roll and the scrap roll are moved away from each other to pull a beginning portion off the replacement roll into a preparation or processing position. While the beginning portion, thus, is in the processing position, for example stretched away from the replacement roll as such, two essentially parallel perforation or tear lines, which extend preferably essentially axially with respect to the roll are placed on the beginning portion. In a third moving step, the scrap roll and the replacement roll are moved relative to each other again to place the beginning portion, now furnished with the perforating or tear lines in engagement with the roll; in a preferred form, a holding adhesive has been applied on the beginning portion while it was in the preparation position. In a fourth moving step, the scrap roll and the replacement roll are moved relative to each other, which may, for example, involve rotation of the replacement roll, which will cause the perforation on the replacement roll closest to the scrap roll to tear, and thus severing the scrap material on the scrap roll from the beginning portion of the web, which is still in engagement with the replacement roll. The scrap material is then removed from the scrap roll, for example by cutting it off axially by a cutter knife, by a laser, or the like.

The method and apparatus or system of the present invention permits use of a straight, axially extending beginning portion of the web, which can be readily made by simple mechanical apparatus, which is reliable and easy to operate. Separate adhesion strips, butterflies or the like, and adhesive tabs, as well as apparatus to apply them, are not required; this simplifies the apparatus as well as the method and permits use of inexpensive apparatus.

DRAWINGS

Figure 3:
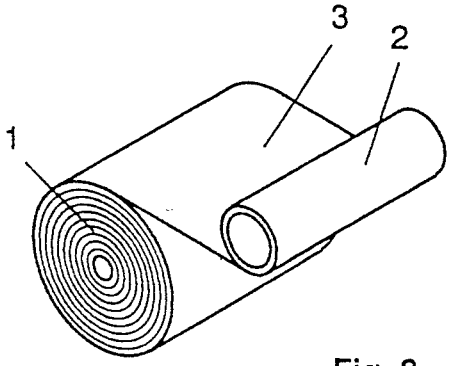
Figure 4:
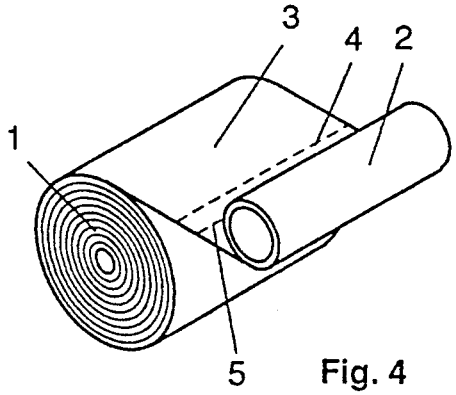
Figure 5:
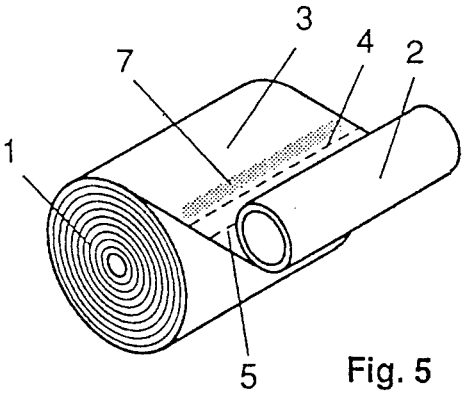
Figure 6:
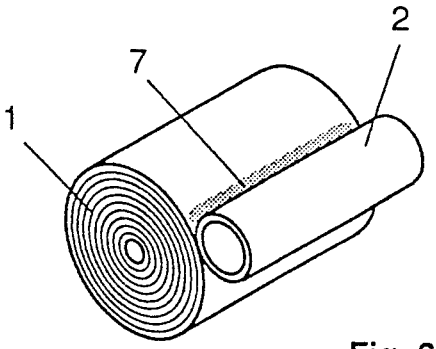
Figure 10:
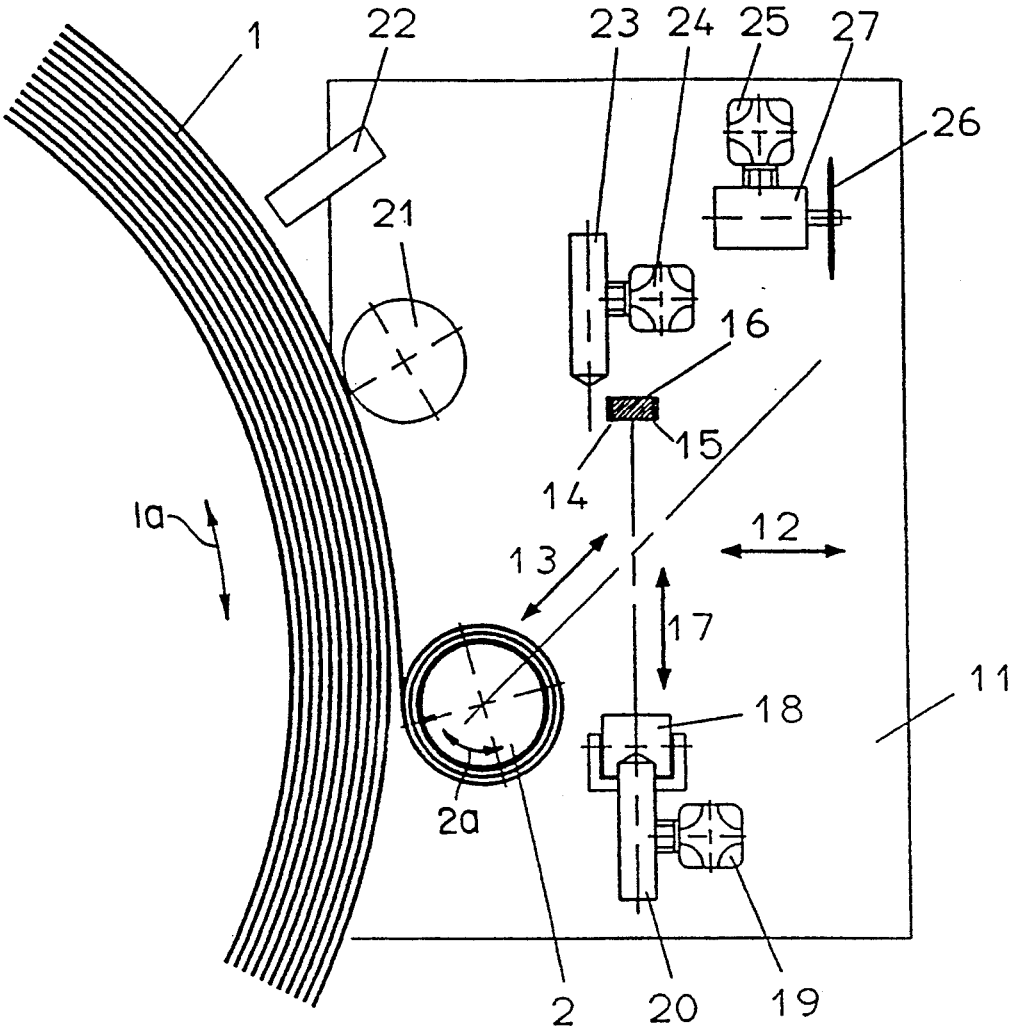
FIG. 10 is a highly schematic side view of the apparatus carrying out the various steps shown in FIGS. 1 through 8, in which the apparatus is in a first position, shown generally in FIGS. 1 and 2.
Figure 10A:
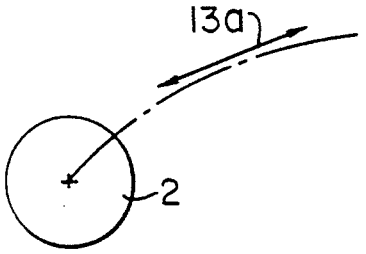
Figure 11:
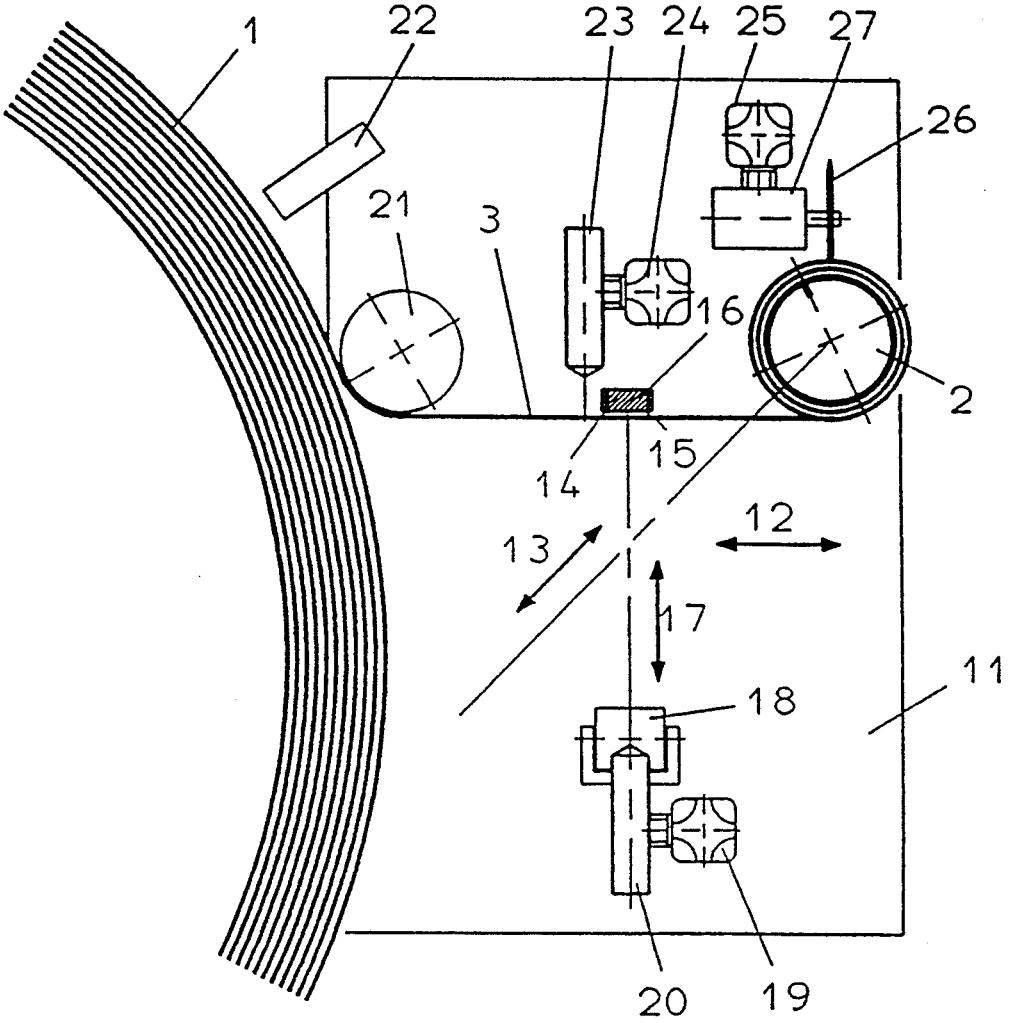
Figure 12:
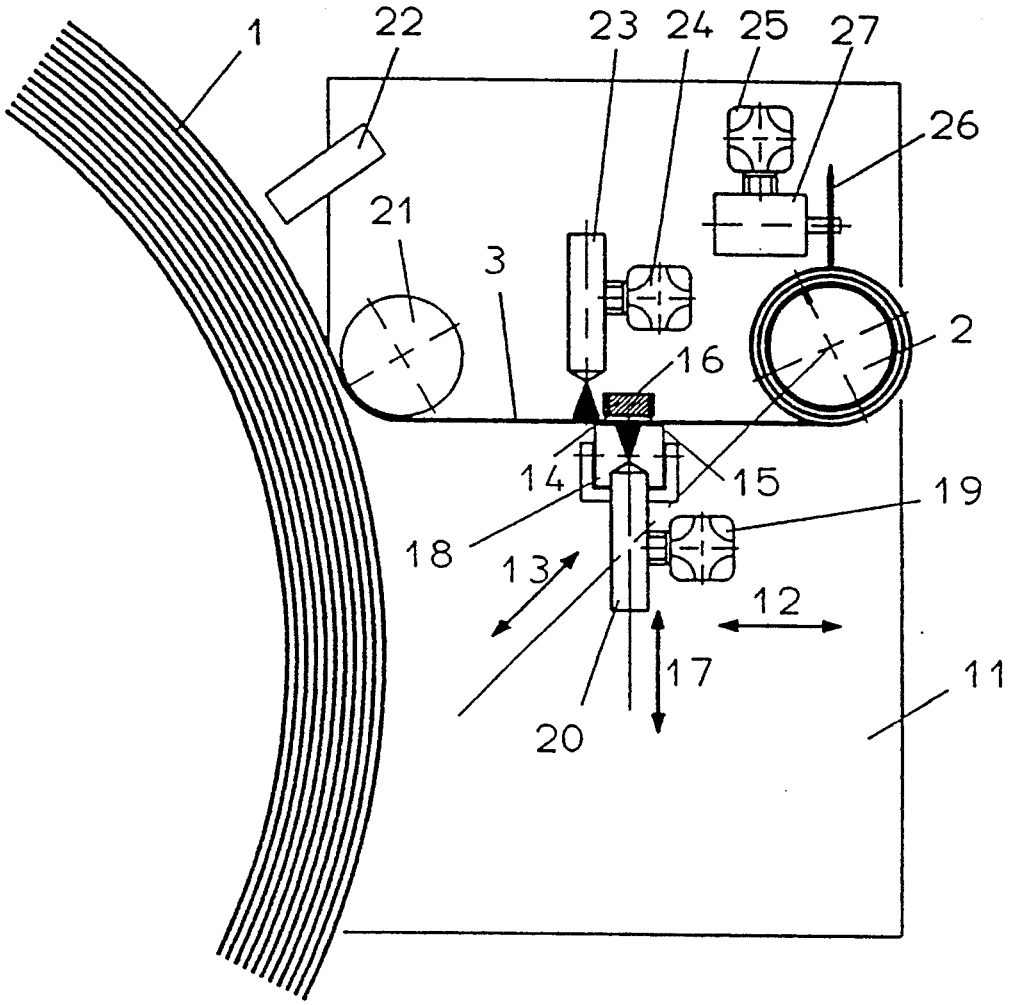
Figure 14:
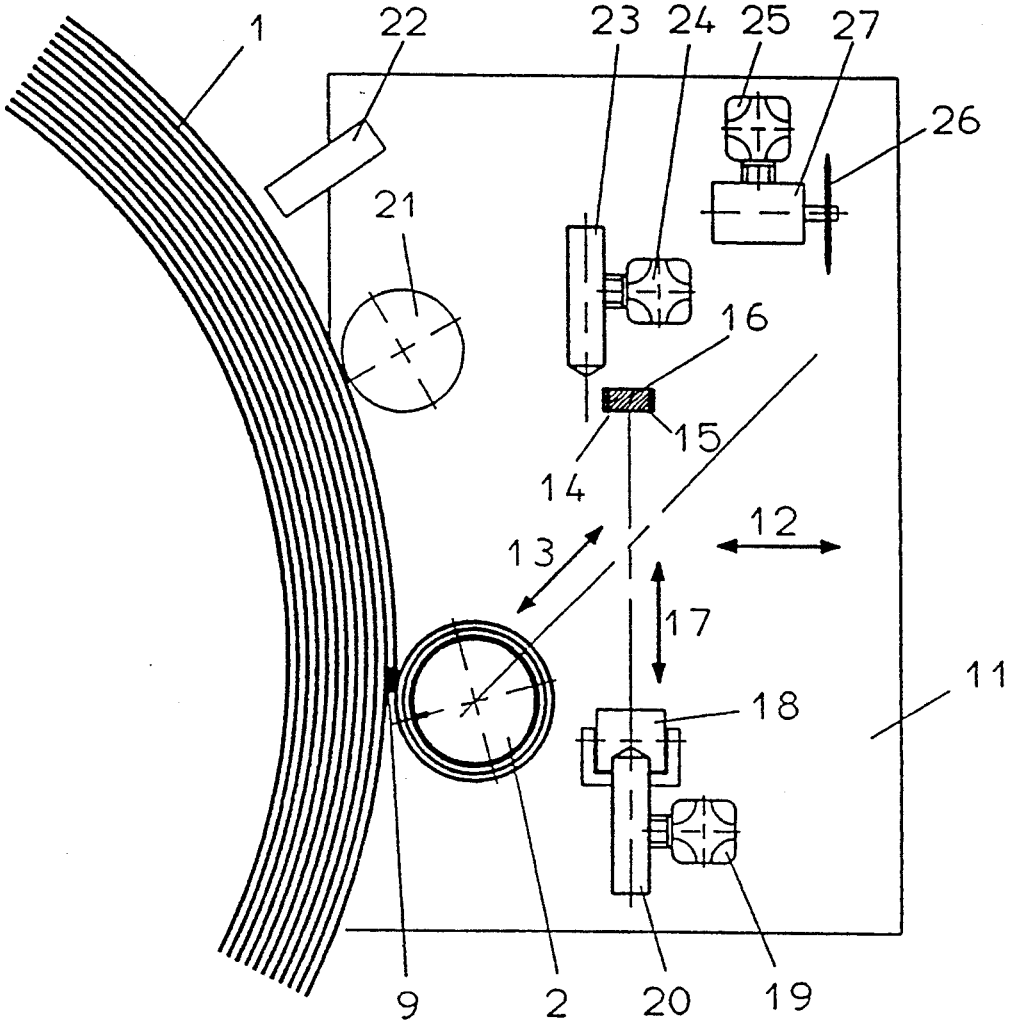
Figure 15:
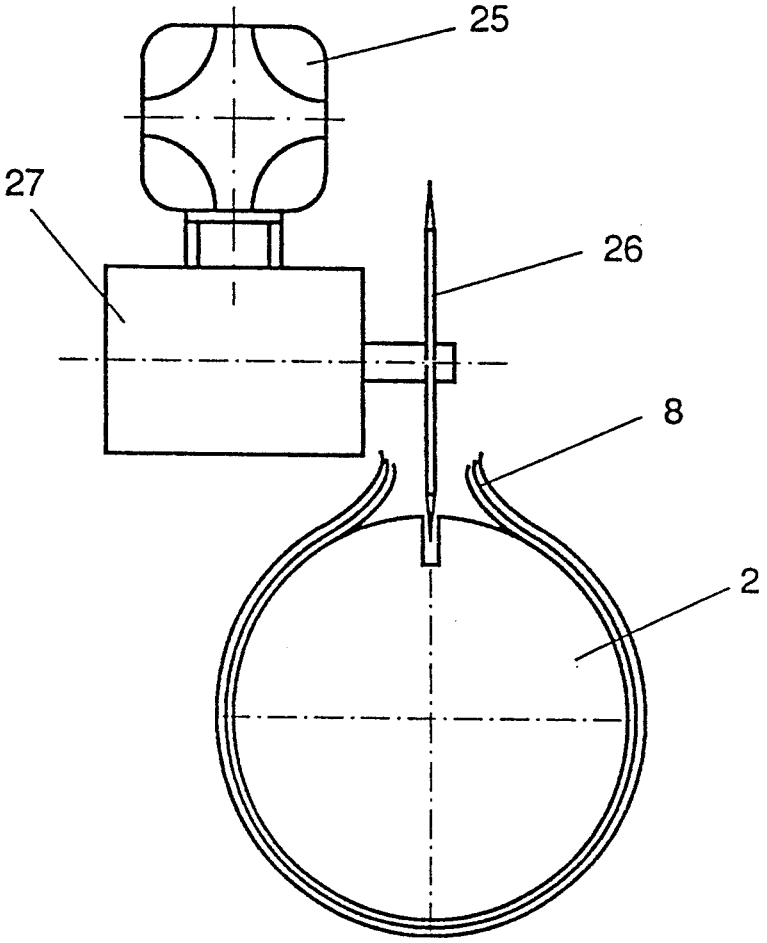
Figure 15A:
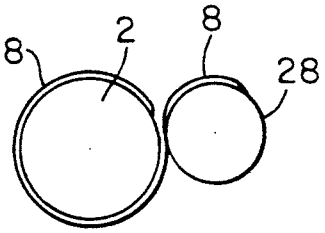
Figure 15B:
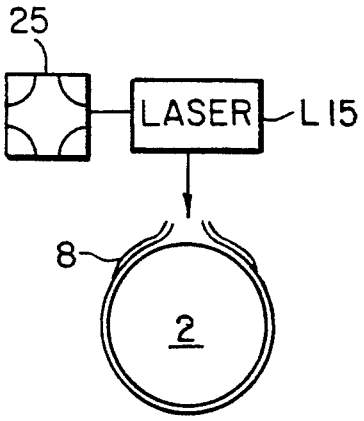

FIG. 10*a* is a framentary view, highly schematic, illustrating a different moving path for the scrap roll;

FIG. 11 is a view of the apparatus of FIG. 10 in which the scrap roll and the replacement roll are in the position shown in FIG. 3;

FIG. 12 illustrates the step of perforation and application of adhesive, in which the scrap roll and the replacement roll are in the positions shown in FIGS. 4 and 5;

FIG. 13 is a detail view of one embodiment of a perforating and adhesive application device;

FIG. 13*a* illustrates another embodiment of a perforating device;

FIG. 14 illustrates the position of the apparatus in which the scrap roll and the replacement roll are in a position shown in FIG. 6;

FIG. 15 illustrates an apparatus to cut off scrap from the scrap roll;

FIG. 15*a* illustrates another arrangement to remove scrap from the scrap roll; and FIG. 15*b* illustrates another severing arrangement to remove scrap from the scrap roll.

DETAILED DESCRIPTION

Figure 1:
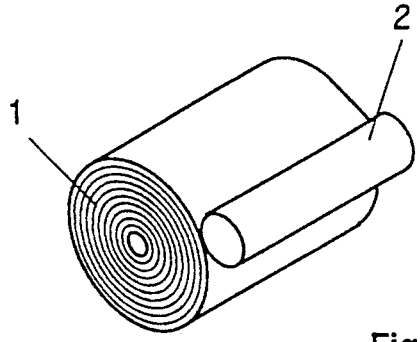
FIGS. 1 to 8 are perspective view of a replacement roll in different, sequential steps of the process of forming the beginning portion for flying roll change.

Referring first to FIG. 1:

A replacement roll 1 has a web of substrate material, typically paper, rolled thereon. When the replacement roll is delivered, it is practically unavoidable that some of the upper windings or layers on the roll are damaged; additionally, they may be adhered to a corrugated or other protected cover. To remove this material which, for simplicity, will be referred to as "scrap", a scrap roller 2 is provided, to which the initial portion of the layer 3 on the roll 1 is adhered or applied. The referenced application Ser. No. 07/971,042, filed Nov. 3, 1992, Dylla, illustrates various arrangements of attaching the beginning of the paper layer on the scrap roll.

Figure 2:
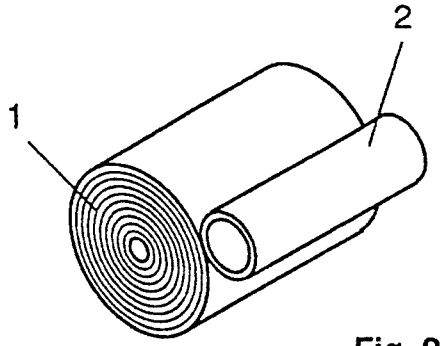

FIG. 2 illustrates that the usually damaged initial portion is applied to the scrap roll 2, for example by winding the scrap on the roll 2.

FIG. 3 shows the next step in which the scrap roll 2 is moved away from the replacement roll 1 to leave a free initial portion 3 between the scrap roll 2 and the replacement roll 1. This beginning portion of the useful part of the web on roll 1 is tightly stretched and roll 1 and scrap roll 2 are now in a preparation or processing position. In the next step (FIG. 4), two axially extending, essentially parallel, spaced perforation or tear lines 4, 5 are applied to the beginning portion 3. At the same time, or subsequently thereto, an adhesive 7 is applied to the upper or outside region adjacent the inner perforation 4 (FIG. 5). This adhesive will form a connection adhesive for flying web change with respect to an expiring web.

In a subsequent, third moving step, the scrap roll 2 and the replacement roll 1 are moved relative towards each other so that the beginning portion 3 is engaged against the underlying layer of the roll 1, for example by an adhesive applied to the beginning portion 3 between the two perforating lines 4 and 5, see FIG. 6.

Figure 7:
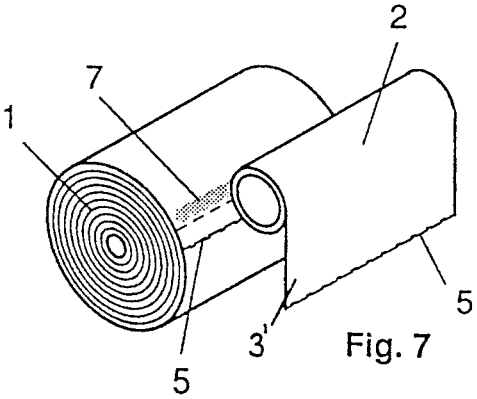
Figure 8:
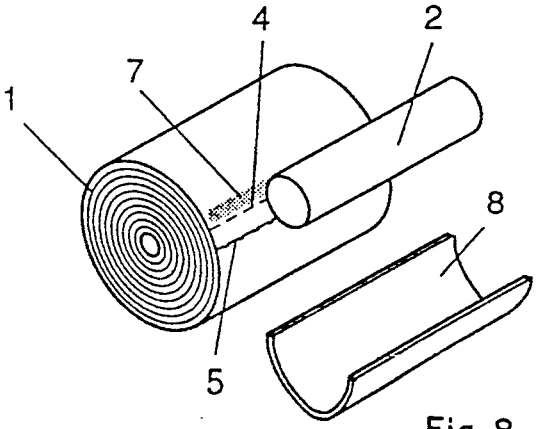

In a fourth moving step, see FIG. 7, the scrap roll 2 and the replacement roll 1 are moved relatively away from other, for example by moving the scrap roll 2 radially away from the replacement roll 1. As a consequence, the perforation 5 will tear, leaving a scrap flap 3', forming part of the initial portion of the web which, for example, can be rolled off the now free scrap roll 2, for example by gravity or otherwise. If desired, the scrap layers 8 on the scrap roller 2 can be removed by axially slitting the scrap layers, as schematically shown in FIG. 8.

Figure 9:
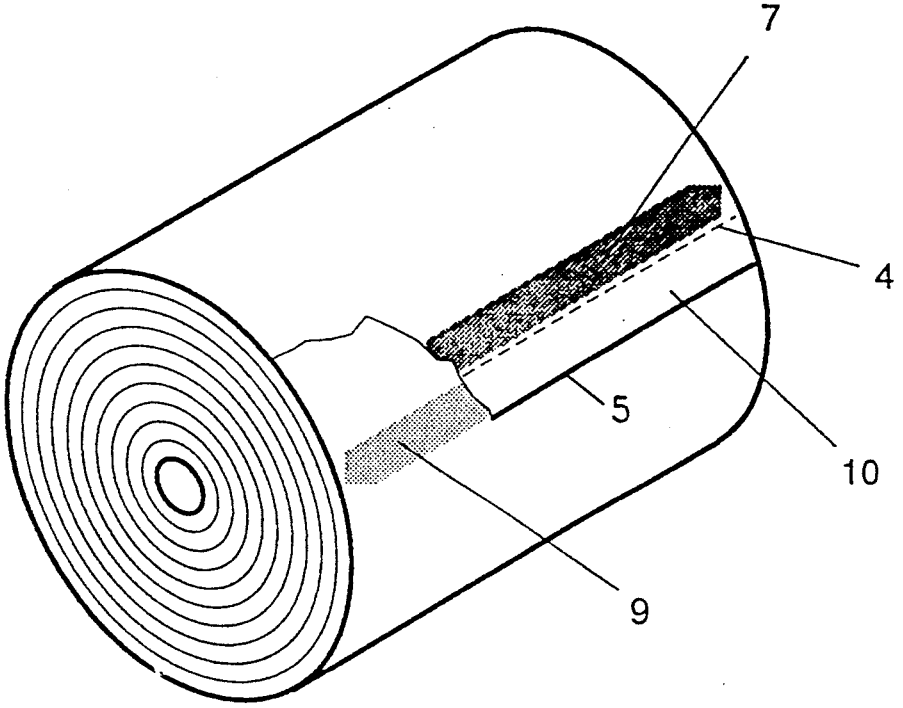
FIG. 9 is a perspective view of the replacement roll, partly cut away, ready for flying roll change with respect to an expiring web.

The completed replacement roll 1, ready for flying roll change, is seen in FIG. 9, in which the adhesive 9, which adheres the beginning portion 10 of the replacement roll 1 against the replacement roll is illustrated. This adhesive strip 9 could have been applied to the bottom of the strip 10, between the perforations 4 and 5, or on the underlying layer of the roll 1; the holding adhesive 9, as seen in FIG. 9, can form a slight residual adhesion strip, even if the adhesive 9 was applied at the underside of the beginning portion 10.

The apparatus to carry out the process illustrated by the sequential FIGS. 1–9 is best seen in FIG. 10. The replacement roll 1 is held in a suitable roll holder, for example two arms of a roll changer (not shown) as well known. A preparation frame 11, which carries all the elements, devices, and apparatus units to prepare the roll 1, is movable towards the roll 1, as schematically shown by the double arrow 12. The double arrows 12, 13 and 14 illustrate not only the direction of movement but also, schematically, suitable moving apparatus coupled to the respective elements, and in case of the double arrow 12, to the frame 11. Such moving apparatus can be rack-and-pinion drives, spindle drives, pivot levers, linear motion transmission elements and the like, all of well known commercial construction.

In accordance with a feature of the invention, the scrap roll 2 is movably retained in the frame 11. The scrap roll 2 itself can be rotated by a suitable drive, shown schematically by the double arrow 2*a*. The scrap roll 2 is movable as shown by the double arrow 13 in the direction of the double arrow; in an alternative embodiment, the roll 2 is moved in a curved path, as schematically shown in FIG. 10*a*, by a curved moving element, for example a swing lever 13*a*.

The frame 11 further retains a knife holder 16 on which two perforating blades 14, 15 are located; details of the perforating blades and the knife holder are seen in FIG. 13. In addition to the perforating knives 14, 15, forming the perforation or tear lines 4, 5 (FIG. 4), the frame 11 also includes an engagement roller 18, movable by a suitable moving apparatus as shown by the double arrow 17, that is, in a path intersecting the moving path 13 of the scrap roller 2. The engagement roller 18 is rotatably secured to a carrier which is coupled to a linear moving apparatus 19 to traverse the roller 18, axially, with respect to the web being rolled off the roll 1. Such linear motion drives and guide elements are well known. Coupled to the roller 18, or its holder structure therefor, is an adhesive application element 20 which applies holding adhesive.

A drive roller 21 is located in the frame 11, in engagement with the uppermost layer of the web on the replacement roll 1. The frame 11 also retains a sensing system 22, which is a system capable of recognizing damage to the paper layer and coupled to or integrated with a suitable evaluation electronics which provides signals indicative of damaged paper on the roll and, conversely, signals that there are no damaged areas. A connection adhesive applicator 23, coupled to a linear drive 24 and extending axially with respect to the replacement roll 1, additionally is retained on the frame 11. A further linear motion apparatus 25, coupled to a severing device shown schematically as a rotating blade knife 26 and a drive motor 27 therefor, is likewise secured to the frame 11.

OPERATION

In a first moving step, the frame 11 is moved towards the replacement roll 1 until the scrap roll 2 is in engagement with the uppermost layer of the roll 1. This position of the frame 11 is shown in FIG. 10. The drive roller 21 is suitably energized and drives the replacement roller 1 in clockwise direction until the sensing system 22 fails to detect damaged paper material (FIG. 2). The damaged paper web is rolled on the scrap roller 2. The scrap roller 2 is rotated by a constant torque motor, schematically shown by the double arrow 2*a*. The roller 2 is in engagement with the circumference of the replacement roll 1.

The initial portion of the web on the replacement roll 1 can be adhered to the roll 2 in any suitable manner, for example by a suction strip or suction tube, an adhesive or the like; details of such engagement are shown in the referenced application Ser. No. 07/971,042, filed Nov. 3, 1992, Dylla.

When all the scrap from the initial portion of the roll 1 has been wound on the roll 2, the drive roller 21 is stopped and the replacement roll 1 will also stop, for example braked by a suitable brake, not shown, and well known in this field.

In a second moving step, the scrap roll 2 is moved away from the replacement roll 1 by the drive system 13 or 13*a*, respectively, as shown, for example, in FIGS. 2 and 11. The beginning portion 3 of the web on the roll 1 is now in a preparation or processing position. In the embodiment shown, the web is guided about the now stationary drive roller 21. Rather than moving the scrap roll 2 in the straight-line path 13 shown in FIG. 11, the path can be curved, see FIG. 10*a*.

In the next operating step, the engagement roller 18 is moved by its moving drive 17 against the perforating or tear line blades 14, 15, as best seen in FIGS. 4 and 12. Next, the engagement roller 18 is moved parallel to the axis of the replacement roller 1 by the linear drive 19; as the engagement roller 18 presses the web against the perforating blades 14, 15, perforations along the perforation or tear lines 4, 5 will result. The adhesive application unit 20, moving linearly together with the roller 18, applies holding adhesive 9 between the perforations 4, 5 to the underside of the web, as illustrated in FIG. 13. Likewise, adhesive application device 20 moves axially, driven by the linear drive 24, and provides the connecting adhesive 7 to the upper side of the web. It should be noted that FIG. 13 is drawn upside-down with respect to FIG. 12; see also FIG. 5. Suitable adhesives are liquid adhesives or double-sided adhesive tapes.

Rather than using an engagement roller 18 and perforating blades 14, 15, dual laser beams from a dual laser apparatus L, which is intermittently energized by an intermittent control unit C, can be used to form the perforations. FIG. 13*a*, highly schematically, illustrates such a system; the engagement roller 18 may also be used, to provide a positive position of the web 3 with respect to the laser beams derived from the laser L.

In a third moving step, the scrap roll 2 is re-engaged towards the replacement roll 1, by moving the frame 11 again generally in the position shown in FIG. 10. Upon doing so, the now adhesively prepared web, having the holding adhesive 9 thereon, is engaged against the replacement roller 1 to form an adhered beginning portion; see also FIG. 6.

In all the steps described so far, the motor 2*a*, having a constant torque, applies that constant torque to the scrap roll 2 to ensure a constant, controlled web tension.

In a fourth moving step, the replacement roll 1 and the scrap roll 2 are moved relative with respect to each other, which causes tearing of the web at the perforation 5. This relative movement can be carried out in various ways, for example by rotating the replacement roll 1 or the scrap roll 2, or both of them, in counterclockwise direction; alternatively, the scrap roll 2 can be moved away from the replacement roll 1, for example by moving the scrap roll 2 in the path shown by the double arrow 13 or 13*a*, respectively (see also FIG. 7).

To remove the scrap from the scrap roll 2, the scrap roll 2 is moved into the region of the circular knife 26 (see FIG. 15). Upon axially moving the knife 26, while rotating it by the motor 27, the layers 8 on roller 2 (see also FIG. 8) are severed and will drop off the scrap roller 2. Alternatively, the layers 8 can be severed by a laser apparatus, positioned to apply a laser beam on the circumference of the scrap roller 2, as schematically shown by FIG. 15*b*. In another embodiment, the scrap can be rolled off the scrap roller 2 by applying an auxiliary roller 28 with an adhesive core tube thereon against the roller 2. Of course, the scrap can also be rolled off the scrap roll 2 by gravity, as schematically shown in FIG. 7 by the portion 3'.

The scrap can be retained on the scrap roll 2 for a plurality of operating cycles, that is, the scrap roll 2 can accept sufficient scrap from several replacement rolls, the beginning portions of which are being prepared in accordance with the above-described sequence. This is particularly appropriate if the scrap roll 2 is constructed as a replaceable, adhesively coated sleeve to which the beginning portion of the web is adhered.

The invention has been described in connection with an example in which the beginning of a replacement roll is suitably prepared for fine roll changing, while the replacement roll is already in a roll changer or other suitable roll-off frame or holder. Of course, the invention is equally applicable for systems in which the roll 1 is located in a suitable roll holder frame remote from a roll changer.

Rather than moving the frame 11 towards the roll 1, the frame 11 can be stationary and the roll 1 can be moved towards the frame; it is only the relative movement which is required in the respective moving steps.

Rather than using the mechanical cutting with the perforating knives 14, 15, the laser perforating system (FIG. 13*a*) may advantageously be used.

In the embodiment illustrated, the holding adhesive is applied on the initial portion of the pulled-off flap from the roll 1, that is, on the initial portion 3. Alternatively, it can be directly applied on the underlying layer of the web on the roll 1, that is, in the region which will fall between the perforations 4, 5 when the beginning portion 3 is re-engaged against the web of the roll 1 (FIG. 6).

Specific, detailed descriptions of the various apparatus elements used to move the frame 11, and the components in the frame, have been omitted from the drawings for clarity. The various commercial devices to move the respective elements in accordance with the double arrows are known; the specific application will depend on costs at the time of construction, size and operating speed requirements.

Various changes and modifications may be made, and any features described herein may be used with any others, within the scope of the inventive concept.

We claim:

1. A method for preparing a replacement paper roll (1) to permit flying roll changing with an expiring roll being supplied to a printing machine, wherein initial portions (3) of the roll form scrap material, and subsequent to removal of the scrap material, the subsequent beginning portion of the roll is supplied with perforations and with a connection adhesive intended for connection to the expiring roll, comprising the steps of in a first moving step, relatively moving a scrap roll (2) and the replacement paper roll (1) towards each other;

in a second moving step, relativing moving the scrap roll (2) and the replacement paper roll (1) to place the beginning portion (10) of the replacement roll, subsequent to the initial portion forming the scrap material, away from the circumference of the replacement roll and into a preparation or processing position;

applying two essentially parallel perforation or tear lines (4, 5) extending axially with respect to the roll on said beginning portion while the beginning portion is in said preparation or processing position;

in a third moving step, relatively moving the scrap roll (2) and the replacement paper roll (1) to place the beginning portion (10) in engagement with the outermost layer of the replacement paper roll (1);

in a fourth moving step, relatively moving the scrap roll (2) and the replacement paper roll (1) to sever the scrap material at one (5) of said perforation or tear lines from the beginning portion (10), while the beginning portion is in engagement with the replacement roll (1); and removing scrap material from the scrap roll (2).

2. The method of claim 1, including, in advance of the third moving step, the step of applying a holding adhesive between the beginning portion (10) and the immediately adjacent underlying layer of the roll to ensure adhesive engagement of the beginning portion with the underlying layer of the replacement roll.

3. The method of claim 1, wherein the second moving step comprises moving the scrap roll away from the replacement roll (1) in an essentially linear path.

4. The method of claim 1, wherein the second moving step comprises moving the scrap roll away from the replacement roll (1) in a curved path.

5. The method of claim 1, wherein the fourth moving step comprises rotating at least one of said rolls (1, 2) counter the direction of rotation which the respective roll assumes when web material is pulled off the respective roll.

6. The method of claim 1, wherein said fourth moving step comprises relatively moving the scrap roll (2) and the replacement paper roll (1) circumferentially away from each other.

7. The method of claim 1, including the step of rolling scrap web material from the replacement paper roll on the scrap roll; and wherein said step of removing the scrap material from the scrap roll (2) comprises axially severing the scrap material on the roll and, optionally, permitting the severed material to separate from the roll by gravity.

8. The method of claim 1, wherein said step of removing the scrap material from the scrap roll comprises winding the scrap material from the scrap roll on an adhesively coated wind-up sleeve (28).

9. The method of claim 1, wherein said step of removing the scrap material from the scrap roll (2) comprising rolling the scrap material off the scrap roll, optionally, by gravity.

10. An apparatus for preparing a replacement paper roll (1) for flying roll changes with an expiring roll being supplied to a printing machine, said apparatus comprising a scrap roll (2) receiving initial portions (3) of layers from the replacement roll and forming scrap material;

adhesive application means (20, 23) for applying holding adhesive and connection adhesive, respectively, to a beginning portion (10) of the replacement roll, which beginning portion is located adjacent to said initial portion (3) of scrap material;

two perforating means (14, 15, 18; L, C) to form two essentially parallel, essentially axially extending perforating or tear lines (4, 5) in said beginning portion (10);

a drive means (2*a*) coupled to rotate and drive the scrap roll (2); and moving means (13, 13*a*) for relatively moving the position of the scrap roll (2) with respect to the replacement roll (1) between a first position, in which the scrap roll is in engagement with, or close to the replacement roll (1), and a second position, in which the scrap roll is spaced from the replacement roll to extend the beginning portion of the web material away from the replacement roll (1) to said second position, and place the beginning portion (10) in a preparation or processing position and, while the beginning portion is in said preparation or processing position, permit perforation of said beginning portion by said perforating means.

11. The apparatus of claim 10, wherein said drive means coupled to the scrap roll is a constant torque drive means (2*a*) applying a constant torque to the circumference of the scrap roll.

12. The apparatus of claim 10, wherein said perforating means comprises a knife carrier (16) including two knife blades (14, 15) spaced from each other and defining a strip between the perforating or tear lines (4, 5) formed by said perforating blades;

an essentially axially movable engagement roller (18) located at a side of the beginning portion remote from the side of the perforating blades, and a linear motion transmission means (19) moving and guiding said engagement roller essentially axially across the beginning portion and engaging the perforating blades against said beginning portion.

13. The apparatus of claim 12, further including a holding adhesive application means (20) applying a holding adhesive to said strip, coupled to and longitudinally movable with said engagement roller (18).

14. The apparatus of claim 10, wherein said perforating means comprises a pulsed laser beam cutter apparatus (L, C) linearly movable across said beginning portion (10).

15. The apparatus of claim 10, further including severing means (26, 27; L15) operatively associated with a circumferential portion of said scrap roll (2); and a linear drive and guide means (25) for moving said severing means axially along the scrap roll (2) to sever scrap material (8) wound on the scrap roll for removal therefrom.

16. The apparatus of claim 10, wherein said moving means (13, 13*a*) are coupled to the scrap roll (2); and wherein a severing means (26, 27; L15), optionally comprising a laser cutting means (L15) is provided, said scrap roll being further movable by said moving means for positioning the scrap roll for severing said beginning portion by said severing means.

17. The apparatus of claim 10, further including a connection adhesive application means (23) and a linear drive and guide means (24) coupled to said connection adhesive application means and linearly moving the connection adhesive application means across the beginning portion (10) when the moving means (13, 13*a*) have relatively moved the scrap roll (2) and the replacement roll (1) in the second position to apply connection adhesive to the beginning portion.

18. The apparatus of claim 10, further including a drive roller (21) positioned for engagement with the replacement roll (1) for rotating the replacement roll.

19. The apparatus of claim 18, wherein said moving means relatively moves the position of the scrap roll with respect to the replacement roll, when in the second position, in a direction in which the beginning portion (10) is partially guided about said drive roller (21).

20. The apparatus of claim 10, further comprising a retention frame (11) relatively movable with respect to the replacement roll (1), said retention frame (11) retaining the scrap roll (2), the moving means (13);

the two perforating means (14, 15, 18; L; C);

wherein the perforating means includes perforating blade means and an engagement roller engaging the initial portion against the perforating blade means, or a pulsed laser beam (L, C);

linear drive and guide means (19) are provided for linearly moving the perforating means across the beginning portion (10) of the layer from the replacement web;

adhesive application means (20, 23) are provided, coupled to be movable with the linear drive and guide means (19);

sensing means (22) sensing when paper layers rolled off the replacement paper roll are free from defects;

a circumferentially engageable drive roller (21) engageable with the circumference of the replacement paper roll is provided;

wherein severing means (26, 27; L15) are provided to sever scrap material (8) from the scrap roller; and wherein the perforating blade means, the engagement roller means or the pulsed laser means, respectively, the linear drive means (19) therefor, the adhesive application means (20, 23), the sensing means (22), the drive roller (21) and the severing means (26, 27; L) are all retained on said retention frame (10).

* * * * *